US008323561B2

(12) United States Patent
Hasegawa et al.

(10) Patent No.: US 8,323,561 B2
(45) Date of Patent: Dec. 4, 2012

(54) FIRE-RESISTANT STEEL MATERIAL SUPERIOR IN HAZ TOUGHNESS OF WELDED JOINT AND METHOD OF PRODUCTION OF SAME

(75) Inventors: Yasushi Hasegawa, Tokyo (JP); Suguru Yoshida, Tokyo (JP); Yoshiyuki Watanabe, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 921 days.

(21) Appl. No.: 12/224,253

(22) PCT Filed: Sep. 20, 2007

(86) PCT No.: PCT/JP2007/068900

§ 371 (c)(1),
(2), (4) Date: Aug. 20, 2008

(87) PCT Pub. No.: WO2008/059669

PCT Pub. Date: May 22, 2008

(65) Prior Publication Data

US 2009/0053097 A1 Feb. 26, 2009

(30) Foreign Application Priority Data

Nov. 14, 2006 (JP) ..... 2006-307683

(51) Int. Cl.
*C22C 38/22* (2006.01)
*C21D 8/00* (2006.01)
*C22C 38/00* (2006.01)

(52) U.S. Cl. ..... 420/106; 148/645; 420/83

(58) Field of Classification Search ..... 148/645; 420/83, 106

See application file for complete search history.

(56) References Cited

U.S. PATENT DOCUMENTS

| | | | | |
|---|---|---|---|---|
| 4,091,147 | A * | 5/1978 | Kanazawa et al. | 428/683 |
| 2001/0035235 | A1* | 11/2001 | Kawano | 148/320 |
| 2006/0179974 | A1* | 8/2006 | Hatano et al. | 75/228 |

FOREIGN PATENT DOCUMENTS

| | | |
|---|---|---|
| CN | 1354273 | 6/2002 |
| CN | 1524976 | 9/2004 |
| EP | 1 008 667 | 6/2000 |
| JP | 3 087332 | 4/1991 |
| JP | 04-268040 | 9/1992 |
| JP | 07-286233 | 10/1995 |
| JP | 8 144012 | 6/1996 |
| JP | 10-096024 | 4/1998 |
| JP | 2000-282167 | 10/2000 |
| JP | 2001-294984 | 10/2001 |
| JP | 2002-115022 | 4/2002 |
| JP | 2004-339549 | 12/2004 |
| JP | 2004-360361 | 12/2004 |
| JP | 2006-28628 | 2/2006 |
| JP | 2006-161275 | 6/2006 |
| JP | 2006-249467 | 9/2006 |
| KR | 100378786 | 5/2001 |
| WO | WO 00/36173 | 6/2000 |

OTHER PUBLICATIONS

International Search Report dated Apr. 15, 2011 issued in corresponding EPO Application No. EP 07 82 8644.

International Search Report dated Jan. 8, 2008 issued in corresponding PCT Application No. PCT/JP2007/068900.

General Fireproof Design Method of Buildings, vol. 4, Table of Contents, and English translation thereof.

* cited by examiner

*Primary Examiner* — Kiley Stoner
*Assistant Examiner* — Alexander Polyansky
(74) *Attorney, Agent, or Firm* — Kenyon & Kenyon LLP

(57) ABSTRACT

The present invention provides a fire-resistant steel material superior in HAZ toughness of a welded joint which is high in high temperature yield strength at an envisioned fire temperature of 700 to 800° C. and is free of embrittlement of the welded joint even if exposed at this envisioned fire temperature and a method of production of the same, that is, a fire-resistant steel material of a composition containing, by mass %, C: 0.005% to less than 0.03%, Si: 0.01 to 0.50%, Mn: 0.05 to 0.40%, Cr: 1.50 to 5.00%, V: 0.05 to 0.50%, and N: 0.001 to 0.005% and restricted in contents of Ni, Cu, Mo, B, P, S, and O obtained by heating a steel slab to 1150 to 1300° C., then hot working or hot rolling the slab to an end temperature of 880 degrees or more, acceleratedly cooling the worked or rolled steel material under conditions of a cooling rate at a position of the slowest cooling rate of at least 2° C./sec or more, stopping this accelerated cooling at a temperature region where the surface temperature of the steel material becomes 350 to 600° C., and then allowing the material to cool.

7 Claims, 2 Drawing Sheets

FIRE-RESISTANT STEEL MATERIAL SUPERIOR IN HAZ TOUGHNESS OF WELDED JOINT AND METHOD OF PRODUCTION OF SAME

TECHNICAL FIELD

The present invention relates to a fire-resistant steel material used when constructing a building structure or other steel structure by welding and a method of production of the same, more particularly relates to a fire-resistant steel material having a high strength even at 700 to 800° C. when exposed to a fire and excellent in HAZ (Heat Affected Zone) toughness of a welded joint even after exposure to such a fire ambient temperature and a method of production of the same.

BACKGROUND ART

The welded structures forming building structures naturally are required to be superior in the properties of the welded joints, but in recent years the property of being superior in tensile strength at a high temperature as so-called "fire-resistant steel" has further become demanded. This is due to the allowance of "performance-based designs" as a result of the findings of the "Development of Refractory Design Methods" studied in a technical development project of the Ministry of Construction (then) entitled "Development of Fireproof Design Methods for Buildings" promoted in the five years from fiscal 1982 to fiscal 1986. Due to this, it has become possible to determine what extent of fire-resistant covering is required by the high temperature strength of the steel material and the load actually applied to the building and it has become possible to use nonfire-resistant covering steel materials in accordance with the high temperature strength properties of steel materials (see *General Fireproof Design Method of Buildings* (*Vol.* 4)—*Refractory Design Methods*, the Building Center of Japan, Apr. 10, 1989).

Here, "fire-resistant performance" is performance of a steel material exhibiting the necessary strength for a certain time when the steel material is exposed to a fire in the state without a fire-resistant covering. This is so as to keep the building structure from collapsing and to thereby facilitate the escape of people residing in it. Various sizes of fires and ambient temperatures may be envisioned, so when not providing a fire-resistant covering on a steel material, the steel material supporting the strength of the structure is required to be as high in strength at a high temperature as possible.

In the past, R&D has been conducted on steel materials provided with such a fire-resistant performance. For example, steel materials improved in high temperature strength by the addition of a suitable quantity of Mo are being proposed (see Japanese Patent Publication (A) No. 2001-294984, Japanese Patent Publication (A) No. 10-096024, and Japanese Patent Publication (A) No. 2002-115022). These steel materials all envision use at less than 700° C. The high temperature strength is raised by precipitation strengthening of Mo carbides or by joint use of precipitation strengthening of other carbides and structural strengthening.

On the other hand, due to the pinch in the supply and demand of various types of alloy elements, the addition of Mo is raising the costs of steel materials industrially. Due to this, technology employing alloy designs involving other than the addition of Mo is being disclosed (see, for example, Japanese Patent Publication (A) No. 07-286233 and Japanese Patent No. 3635208). In the low yield ratio steel material for building use described in Japanese Patent Publication (A) No. 07-286233, B is added to improve the hardenability so as to secure high temperature strength at about 600° C. Further, in the low yield ratio fire-resistant steel plate described in Japanese Patent No. 3635208, the high temperature strength is improved by adding Cu, Mn, or another γ-phase stabilizing element.

Further, Japanese Patent Publication (A) No. 2006-249467 discloses a steel material superior in HAZ toughness of the welded joints improved in high temperature strength at 750° C. by compositely adding B and Mo.

DISCLOSURE OF THE INVENTION

However, the above prior art has the problem shown below. As already explained, in a structure using a steel material without a fire-resistant covering, there is of course no upper limit on the ambient temperature of the fire, that is, the temperature to which the steel material is exposed. Depending on the conditions of the fire, the material may be exposed to a high temperature of 700° C. or more. In particular, at the lower floors of a high storey building, sometimes there are many combustibles and the fire continues for a long time. The temperature of the steel material itself sometimes becomes 700° C. or more.

As opposed to this, the conventional fire-resistant steel material described in the above Japanese Patent Publication (A) No. 2001-294984, Japanese Patent Publication (A) No. 10-096024, and Japanese Patent Publication (A) No. 2002-115022 is only designed in alloy composition to enable an envisioned temperature of less than 700° C. to be withstood. Japanese Patent Publication (A) No. 2006-249467 is one of the few prior art achieving improvement of the strength at a high temperature of 700° C. or more. In this way, in the past, there was the problem that almost no steel material designed in alloy ingredients focusing on the high temperature strength of a temperature of 700° C. or more, in particular high temperature tensile strength, was ever proposed. The fact that there are few examples of conventional fire-resistant steel materials envisioning a temperature of 700° C. or more can be deduced from the fact that alloy ingredients are mostly designed so as to include Mo, which does not precipitate much at all at 700° C. or more, as a main strengthening element and, further, is clear from the fact that no technical documents can be found describing that the tensile strength at a high temperature of 700° C. or more, that is, substantially 700 to 800° C., is the standard stress (for example, ⅔ to ½ of the standard tensile yield strength at room temperature) or more.

Further, in the steel material described in the above-mentioned Japanese Patent Publication (A) No. 07-286233 and Japanese Patent No. 3635208, a γ-phase stabilizing element is added to improve the high temperature strength, but as is well known, the $Ac_1$ transformation point of Fe is close to 720° C. If adding Cu and Mn or other γ-phase stabilizing elements, there is the problem that the $Ac_1$ transformation point falls correspondingly. This idea in alloy design of adding a γ-phase stabilizing element clearly is not a design considering the strength at a high temperature of 700° C. or more. That is, in the past, nothing was disclosed regarding the technology for design of a steel material exhibiting strength at a high temperature of 700° C. or more.

Furthermore, in high temperature materials, in general, there are almost no examples considered a problem in the usage environment, so there are few steel materials strictly paying attention to the HAZ toughness of the welded joints, but in the case of steel materials used for building structures or other steel structures, unless the HAZ toughness of the welded joints is secured, the earthquake resistance and other problems of welded joints of welded structures cannot be avoided. In particular, studies by the inventors regarding high temperature reheat embrittlement, which was not a problem faced by building structures in the past, found that in fire-resistant steel materials, sometimes the welded joints were reheated at the time of a fire and embrittlement of the welded joints occurred. For example, if the steel material is heated once to 600° C. and then the temperature falls to room temperature, in almost all cases usually the material properties are not considered a problem, but when considering saving lives, repairing damage, and reutilizing the steel material, sometimes the HAZ toughness of the welded joints becomes an issue. Further, embrittlement similar to reheat embrittlement is also a concern in petrochemical plants. However, in the past, this phenomenon was considered a problem for fire-resistant steel materials. There is no example of art providing a solution for this being disclosed. Usually, like in the technology described in Japanese Patent Publication (A) No. 2006-249467, the toughness of the joint as welded was almost always considered. The toughness after a fire distinctive to fire-resistant steel was not considered.

The present invention was proposed in consideration of the above problems and has as its object the provision of a fire-resistant steel material superior in HAZ toughness of a welded joint which is high in high temperature yield strength at an envisioned fire temperature of 700 to 800° C. and does not suffer from embrittlement of HAZ of a welded joint even if exposed to this envisioned fire temperature and a method of production of the same.

The fire-resistant steel material superior in HAZ toughness of a welded joint according to the present invention is characterized by containing, by mass %, C: 0.005% to less than 0.03%, Si: 0.01 to 0.50%, Mn: 0.05 to 0.40%, Cr: 1.50 to 5.00%, V: 0.05 to 0.50%, and N: 0.001 to 0.005%, limiting Ni: less than 0.10%, Cu: less than 0.10%, Mo: less than 0.05%, and B: 0.0003% or less, having a balance of Fe and unavoidable impurities, and, among the unavoidable impurities, limiting P: less than 0.020%, S: less than 0.0050%, and O: less than 0.010%.

This fire-resistant steel material may further contain, by mass %, one or both elements of Ti: over 0.005% to 0.050% and Zr: 0.002 to 0.010%.

Further, this fire-resistant steel material may contain, in addition to the above ingredients, by mass %, Nb: 0.010 to 0.300%. In this case, the following formula (1) must be satisfied. Note that in the following formula (1), [Nb] is the Nb content (%) and [C] is the C content (%).

$$[Nb]\times[C]<0.007 \quad (1)$$

Furthermore, the material may further contain, by mass %, one or more elements selected from the group of Mg: 0.0005 to 0.005%, Ca: 0.0005 to 0.005%, Y: 0.001% to 0.050%, La: 0.001% to 0.050%, and Ce: 0.001% to 0.050%.

A method of production of fire-resistant steel material superior in HAZ toughness of a welded joint according to the present invention is characterized by having a step of heating a steel slab of a composition containing, by mass %, C: 0.005% to less than 0.03%, Si: 0.01 to 0.50%, Mn: 0.05 to 0.40%, Cr: 1.50 to 5.00%, V: 0.05 to 0.50%, and N: 0.001 to 0.005%, restricted to Ni: less than 0.10%, Cu: less than 0.10%, Mo: less than 0.05%, and B: 0.0003% or less, having a balance of Fe and unavoidable impurities, and restricted in the unavoidable impurities to P: less than 0.020%, S: less than 0.0050%, and O: less than 0.010%, to 1150 to 1300° C., then hot working or hot rolling it at an end temperature of 880 degrees or more and a step of acceleratedly cooling the worked or rolled steel material under conditions of a cooling rate at a position of the slowest cooling rate in the steel material of at least 2° C./sec or more until a temperature region of a surface temperature of 350 to 600° C., then allowing the material to cool.

In this method of production of fire-resistant steel material, the steel slab may further contain, by mass %, at least one element of Ti: over 0.005% to 0.050% and Zr: 0.002 to 0.010% and may further contain Nb in addition to the above ingredients, in which case having to contain, by mass %, Nb: 0.010 to 0.300% and having a product of the Nb content and the C content of less than 0.007. It may further contain one or more elements selected from the group of Mg: 0.0005 to 0.005%, Ca: 0.0005 to 0.005%, Y: 0.001% to 0.050%, La: 0.001% to 0.050%, and Ce: 0.001% to 0.050%.

BEST MODE FOR CARRYING OUT THE INVENTION

Figure 1:
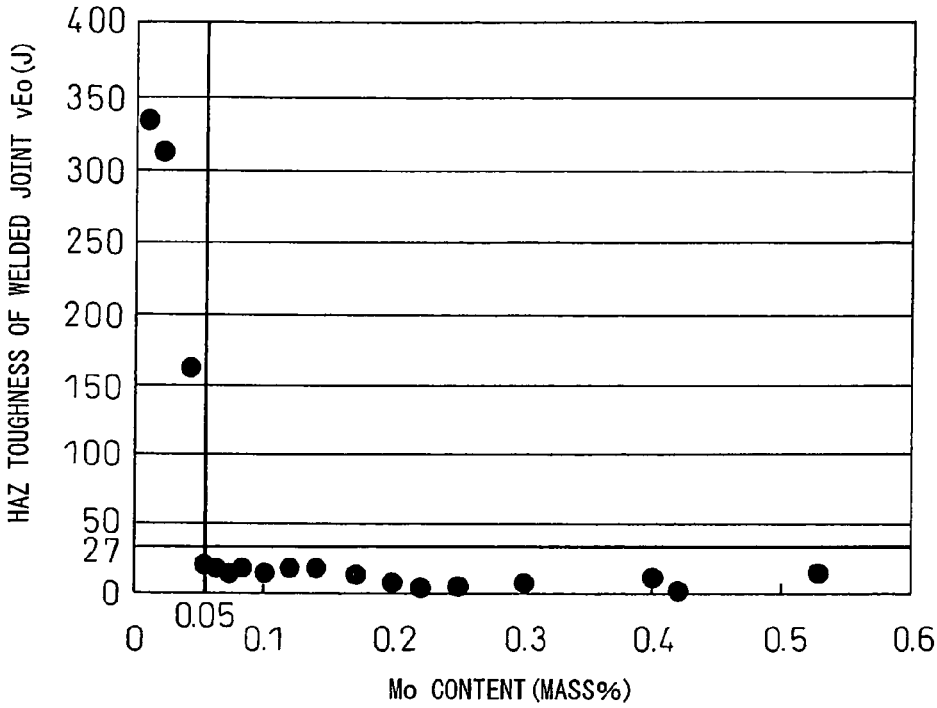
FIG. 1 is a graph plotting the Mo content on the abscissa and the HAZ toughness of the welded joint on the ordinate and showing the relationship between the Mo content and the HAZ toughness of the welded joint after an envisioned fire.

Below, the best mode for carrying out the present invention will be explained in detail. The inventors worked to solve the above problems by optimizing the chemical ingredients of the steel material so obtain a strength of at least ½ of the standard strength at room temperature in the temperature range of 700 to 800° C. and by engaging in intensive experiments and research regarding an alloy composition giving an $Ac_1$ transformation point at least 50° C. higher than the envisioned fire temperature of 700 to 800° C. and thereby obtained the following discoveries.

First, to maintain the strength of a steel material at a high temperature of 700° C. or more, it is necessary to mainly utilize carbide-based precipitates and simultaneously cause these carbides to finely disperse and precipitate. The fine dispersion and precipitation of the carbides are means for enabling precipitation on the dislocations in the crystal grains to be achieved most stably industrially. Research by the inventors found that to obtain high temperature strength, it is necessary to raise the density of dislocations in the crystal grains when producing the steel material. From the viewpoint of the metal structure, to give an upper bainite structure and stably realize precipitation of carbides on the dislocations in the crystal grains having this bainite structure, it is necessary that the hardenability be high and furthermore that carbides be added in the necessary amount. The hardenability itself is a yardstick in alloy design. When producing an actual steel material, accelerated cooling may be used to raise the apparent hardenability of the steel material. That is, it is necessary to determine the alloy composition to cause precipitation of chemically stable carbides at 700° C. or more and to use accelerated cooling at the time of production to introduce sufficient dislocations in the grains and realize fine dispersion of stable carbides. Furthermore, the determined alloy composition must be a composition with a transformation point of 750 to 850° C. or more and an $Ac_1$ transformation point at least 50° C. higher than the ambient temperature to which the member is exposed.

The inventors considered all of these together and discovered that by selecting Cr as the element for improving the hardenability and making the content 1.5 mass % or more, it is possible to secure hardenability and furthermore that for sufficient introduction of dislocation density, that is, introduction of a bainite structure, it is effective to make the cooling rate after hot working 2° C./sec. At this time, addition of any element lowering the $Ac_1$ transformation point to improve the hardenability must be eliminated as much as possible. As alloy elements corresponding to this, there are Ni, Cu, and Mn. C and N are similar. However, C is essential for forming stable carbides. A certain amount has to be added. Further, Mn is a deoxidizing element, so complete elimination is difficult, therefore addition of a certain amount is unavoidable. Therefore, in the present invention, Ni and Cu are in principle not added. Considering their entry as impurities, the upper limits of inclusion of these elements are set and the drop in the $Ac_1$ transformation point is stably suppressed. Further, N also has to be reduced to the level of an impurity, but stable nitrides also contribute to improvement of the high temperature yield strength, so the amount of addition was controlled to a low level.

On the other hand, securing the HAZ toughness of the welded joints of a steel material exposed to a fire environment is also an important issue in the present invention. This means that it is necessary to simultaneously consider an alloy design enabling suppression of the reheat embrittlement occurring at the time when the steel material is exposed to the envisioned fire temperature of 700 to 800° C. For this reason, it is necessary to eliminate harmful elements in reheat embrittlement. Mo and Nb easily precipitate at grain boundaries, so addition must be avoided as much as possible. However, research by the inventors found that since the decomposition temperature is high, if Nb finely precipitates at the time of a fire, it will have no effect on reheat embrittlement and further that formation of precipitates at the grain boundaries is strongly involved in reheat embrittlement. Further, the inventors discovered that if in a range satisfying the following formula (2), addition of Nb to a certain extent can be used for improvement of the high temperature yield strength. Note that the [Nb] in the following formula (2) is the Nb content (mass %), while the [C] is the C content (mass %):

$$[Nb]\times[C]<0.007 \quad (2)$$

Further, Mo is also an element easily precipitating at the grain boundaries. When this coarsely precipitates at the grain boundaries as carbides, it does not contribute to strength and only invites a drop in HAZ toughness of the welded joint. For this reason, the amount of addition of Mo also has to be strictly reduced. Furthermore, B may be mentioned as an element effective for improvement of the hardenability and not causing a drop in the $Ac_1$ transformation point. However, research by the inventors found that B precipitates at the grain boundaries in the form of BN at the above-mentioned envisioned fire temperature and that embrittlement of the welded joint is strongly induced. Therefore, in the present invention, the B content also has to be strictly restricted. Note that embrittlement of the welded joint naturally involves various types of impurities. Among these, P and S are harmful. It is necessary to restrict the upper limits of addition. Further, regarding the S, it is effective to add various types of sulfide control elements.

Below, the reasons for addition of the essential ingredients and the reasons for numerical limitations in the chemical composition of a fire-resistant steel material superior in HAZ toughness of a welded joint of the present invention (hereinafter simply referred to as "fire-resistant steel material") will be explained. Note that in the following explanation, the mass % in the composition will be simply expressed as "%".

C: 0.005% to less than 0.03%

C is an element effective for improvement of the hardenability of the steel material and simultaneously an element essential for forming carbides. However, the diffusion rate is much larger compared with another transition metal element. When aiming at fine precipitation of carbides on the dislocations, since the carbon content becomes the factor determining the size of the carbides, attention must be paid to the amount of addition. Specifically, to cause precipitation of stable carbides at a high temperature of 700° C. or more, it is necessary to add C in an amount of 0.005% or more. On the other hand, if the C content becomes 0.03% or more, the hardenability becomes higher and, when the thickness of the steel material becomes a relatively thin one of 30 mm or less, even if adjusting the cooling rate, the room temperature strength may become too high and the toughness of the steel material itself may be impaired. Therefore, the C content is made 0.005% to less than 0.03%.

Si: 0.01 to 0.50%

Si is a deoxidizing element and an element contributing to the improvement of the hardenability as well. However, if the Si content is less than 0.01%, the effect is not exhibited. On the other hand, if the Si content is over 0.50%, since Si is a ferrite-phase stabilizing element, structural control by accelerated cooling becomes difficult and the dislocation density may not be able to be raised to the extent necessary. Therefore, the Si content is made 0.01 to 0.50%.

Mn: 0.05 to 0.40%

Mn is a γ-phase stabilizing element and contributes to the improvement of the hardenability. However, if the Mn content is less than 0.05%, the effect does not appear. On the other hand, if the Mn content is over 0.40%, the $Ac_1$ transformation point of the steel material ends up being reduced and securing a high temperature yield strength of 700° C. or more becomes difficult. Therefore, the Mn content is made 0.05 to 0.40%.

Cr: 1.50 to 5.00%

Cr has the effect of remarkably raising the hardenability of the steel material by addition of 1.50% or more. Further, it is also high in affinity with C, is stable at a high temperature, and has the effect of suppressing coarsening of elements extremely high in affinity with C such as Nb, V, and Ti. However, if adding a large amount over 5.00%, the result may be an α single phase steel with no transformation point. Therefore, the Cr content is made 1.50 to 5.00%. Note that if adding a large amount of V or Si in the steel, it is preferable to make the Cr content 1.50 to 3.50%.

V: 0.05 to 0.50%

V forms carbides which easily finely disperse in the grains and is an extremely promising element for improvement of the high temperature yield strength. However, if the V content is less than 0.05%, the effect will not appear. On the other hand, if adding V over 0.50%, conversely it coarsely precipitates and no longer contributes to the improvement of the strength. Therefore, the V content is limited to 0.05 to 0.50%.

N: 0.001 to 0.005%

In the present invention, N is not deliberately added. It is an element which should be controlled so as not to form coarse nitrides. However, if in fine amounts, it is chemically stabler than carbides, so precipitates as carbonitrides and contributes to improvement of the high temperature yield strength. Specifically, reducing the N content to less than 0.001% is difficult industrially. Further, to suppress the formation of coarse nitrides, it is necessary to make the N content 0.005% or less. Therefore, the N content is made 0.001 to 0.005%.

Ni: less than 0.10%, Cu: less than 0.10%

Ni and Cu are elements effective for improvement of the hardenability. As explained above, Ni and Cu cause the $Ac_1$ transformation point to remarkably drop, so even if entering as impurities, must be removed by refining technology or the refining step must be designed to prevent their entry. Specifically, if the Ni content or Cu content exceeds 0.10%, the drop in the $Ac_1$ transformation point becomes remarkable. Therefore, the Ni content or Cu content each should be restricted to less than 0.10%.

Mo: less than 0.05%, B: 0.0003% or less

Figure 2:
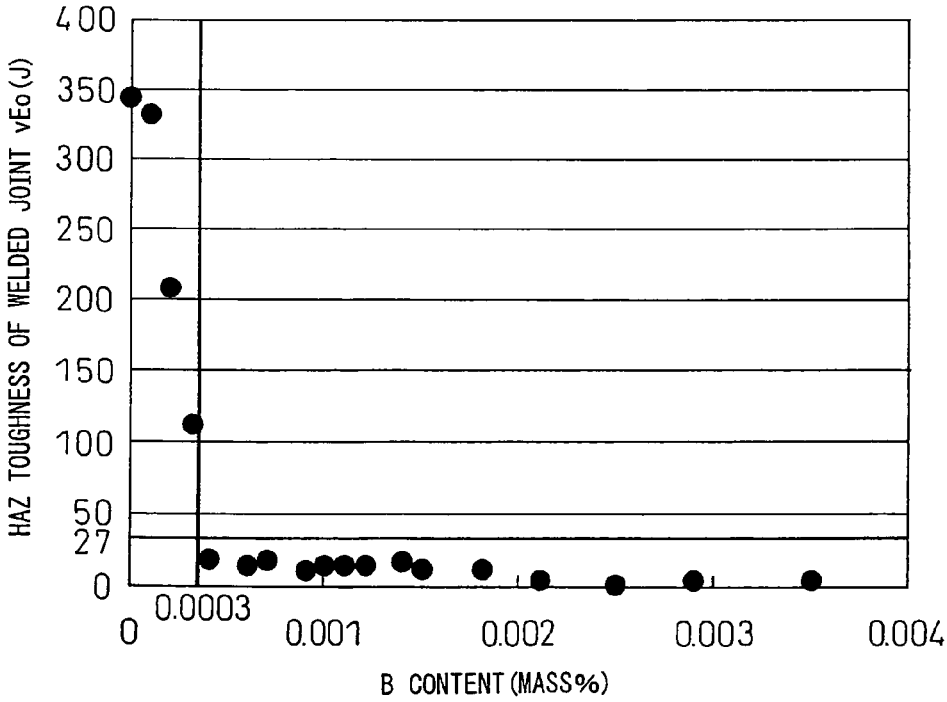
FIG. 2 is a graph plotting the B content on the abscissa and the HAZ toughness of the welded joint on the ordinate and showing the relationship between the B content and the HAZ toughness of the welded joint after an envisioned fire.

Mo and B, like the above-mentioned Ni and Cu, are effective for improvement of the hardenability, but from the viewpoint of the prevention of reheat embrittlement of HAZ of the welded joint after a fire, addition of Mo and B is not preferable. They must be avoided even if entering as impurities. Therefore, the inventors conducted studies of the Mo content and B content and clarified experimentally these strict limitations on content. Specifically, as heat treatment envisioning a fire, a welded joint prepared in advance by a weld heat input of 5 kJ/mm was raised to the envisioned temperature, that is, a temperature of 700 to 800° C., over 1 hour, held at that envisioned temperature for 1 hour, then allowed to cool as treatment for accelerating embrittlement. As the toughness of the interface (fusion line) between the welded joint and matrix at the welded joint after this heat treatment envisioning a fire, the inventors conducted Charpy impact tests repeatedly three times on No. 4 impact test pieces given 2 mm V-notches based on JIS Z 2202 and used the smallest value of the absorption energy at 0° C. $vE_0$ to represent the HAZ toughness. Further, for the steel material covered, 300 kg vacuum melted materials prepared in the laboratory from several ingredients differing in Mo content were used. FIG. 1 is a graph plotting the Mo content on the abscissa and the HAZ toughness of the welded joint on the ordinate and showing the relationship between the Mo content and the HAZ toughness of the welded joint after an envisioned fire. Studies by the inventors found that, as shown in FIG. 1, when the Mo content is 0.05% or more, the HAZ toughness of the joint becomes less than 27 J. Further, the inventors studied B in the same way as the above-mentioned Mo. Note that for B, the inventors carefully ran chemical analyses and detected 1 ppm or more of B to investigate the relationship between the B content and the HAZ toughness. FIG. 2 is a graph plotting the B content on the abscissa and the HAZ toughness ($vE_0$) of the welded joint on the ordinate and showing the relationship between the B content and the HAZ toughness of the welded joint after an envisioned fire. As shown in FIG. 2, it was learned that if the B content is over 0.003%, the HAZ toughness becomes less than 27 J. Based on these experimental results, in the present invention, the Mo content is limited to less than 0.05% and the B content is limited to 0.003% or less. Due to this, it is possible to prevent reheat embrittlement of HAZ of the welded joint.

P: less than 0.020%, S: less than 0.0050%, and O: less than 0.010%

P, S, and O are unavoidable impurities included in the steel. These elements have a serious effect on the toughness of the steel material itself and also have an effect on the reheat embrittlement after a fire. Specifically, if the P content is 0.020% or more, the S content is 0.0050% or more, or the 0 content is 0.010% or more, the toughness of the steel material falls and the reheat embrittlement becomes remarkable. Accordingly, the P content is limited to less than 0.020%, the S content to less than 0.0050%, and the O content to less than 0.010%.

Due to the above limitation of alloy elements, the fire-resistant steel material of the present invention is superior in HAZ toughness after a fire when made into a welded joint and gives a high yield strength at a high temperature of 700 to 800° C.

Next, the reasons for addition of the optional ingredients in the fire-resistant steel material of the present invention and the reasons for the numerical limitations will be explained.

In the fire-resistant steel material of the present invention, in addition to the above ingredients, it is possible to add at least one of Ti and Zr and/or Nb.

Ti: over 0.005% to 0.050%, Zr: 0.002 to 0.010%

Ti and Zr are powerful nitride-forming elements and elements effective for precipitation strengthening. Further, the Ti and Zr easily form carbides and, in the fire-resistant steel material of the present invention, precipitate as carbonitrides. However, if the Ti content is 0.005% or less and the Zr content is less than 0.002%, the strengthening ability is not exhibited. On the other hand, if the Ti content exceeds 0.050% or the Zr content exceeds 0.010%, these precipitate as carbides and, for example, end up suppressing the precipitation of other carbides. Accordingly, when adding Ti and/or Zr, the Ti content is made over 0.005% to 0.050% and the Zr content is made 0.002 to 0.010%.

Nb: 0.010 to 0.300%

Figure 3:
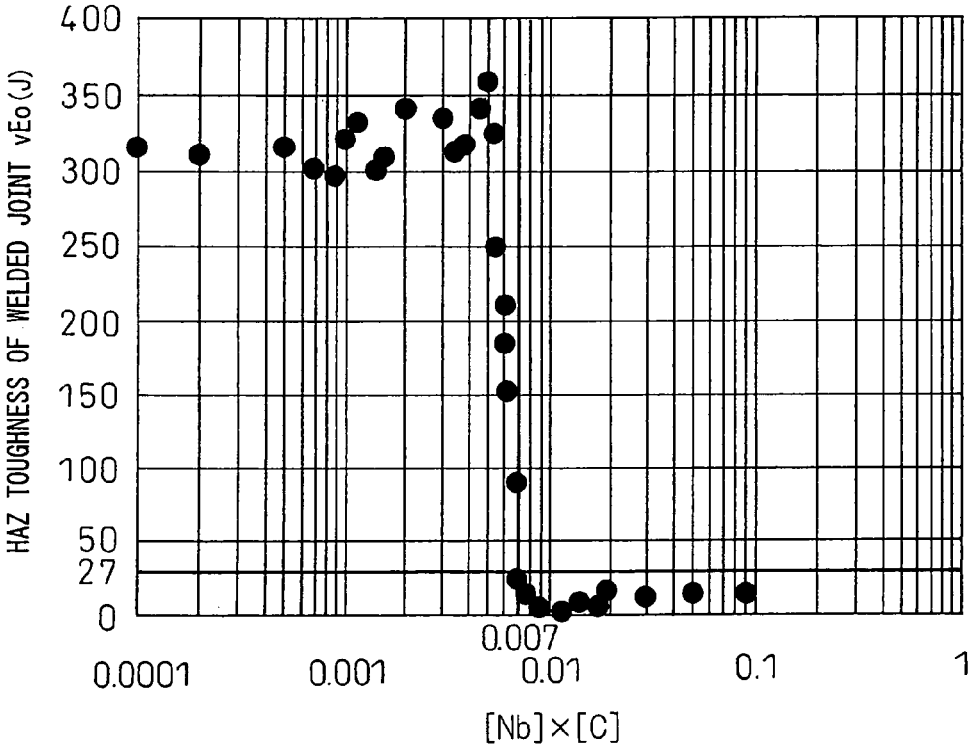
FIG. 3 is a graph plotting the product of the Nb content and the C content ([Nb]×[C]) on the abscissa and the HAZ toughness of the welded joint on the ordinate and showing the relationship between the product of the Nb content and the C content and the HAZ toughness of the welded joint after an envisioned fire.

Nb can contribute to the improvement of the high temperature yield strength by precipitation strengthening if added in an amount of 0.010% or more. However, if added over 0.300%, the precipitation of coarse NbC induces reheat embrittlement after a fire. Accordingly, when adding Nb, the content is limited to 0.010 to 0.300%. However, the embrittlement mechanism of Nb is due to the grain boundary precipitation of NbC, so Nb is preferably added in a range satisfying the experimental formula shown in formula (2), that is, a range where the product of the Nb content ([Nb]) and the C content ([C]) ([Nb]×[C]) becomes less than 0.007. FIG. 3 is a graph plotting the product of the Nb content and the C content on the abscissa and the HAZ toughness ($vE_0$) of the welded joint on the ordinate and showing the relationship between the product of the Nb content and the C content and the toughness of the welded joint after an envisioned fire. Formula (2) gives values determined from this FIG. 3.

Note that due to the limitation on the S content and the rectification of the Mn content explained before, the fire-resistant steel material of the present invention basically has little formation of MnS at the center segregated parts. However, at the time of mass production, it is difficult to stably eliminate the formation of MnS at the center segregated parts. Therefore, in the fire-resistant steel material of the present invention, to reduce the effect of sulfides on the toughness of the steel material, it is possible to add a sulfide control element. Specifically, it is possible to selectively include one or more elements of Mg: 0.0005 to 0.005%, Ca: 0.0005 to 0.005%, Y: 0.001% to 0.050%, La: 0.001% to 0.050%, and Ce: 0.001% to 0.050%. Due to this, it is possible to suppress the drop in toughness of the steel material due to sulfides and possible to further raise the effect of the present invention explained above. Note that when adding these elements, if less than the lower limit value, the effect is not obtained, while if over the upper limit of addition, coarse oxide clusters are formed and unstable breakage of the steel material may occur.

Next, the method of production of fire-resistant steel material of the present invention configured in the above way will be explained. In the present invention, as means for raising the high temperature yield strength at 700 to 800° C., the chemical ingredients of the fire-resistant steel material are defined. However, to produce a steel material able to exhibit a high temperature yield strength with a good industrial yield, it is further effective to define the method of production. There are various ways of thinking about the mechanism for obtaining strength at a high temperature, but the inventors engaged in research and as a result came up with the idea that the dislocations of a metal structure stop the movement of dislocations present in crystal grains at a high temperature and thereby suppress plastic deformation of the steel material itself. Therefore, the steel material requires the density of dislocations necessary for maintaining the high temperature yield strength high at first. To prevent these dislocations from easily moving even at a high temperature, it is necessary to form a metal structure utilizing the reaction between precipitates and dislocation. As art for reliably obtaining such a metal structure, the technique of controlled rolling and quenching of the steel material is used. However, research of the inventors found that in a steel material for buildings, from the viewpoint of the earthquake resistance, workability, and weldability, when the strength of the material structure at room temperature becomes too high, sometimes the material sometimes can no longer be substantially installed, so it is necessary to stop the accelerated cooling mid way to avoid an extreme rise of the dislocation density, for example, a high density dislocation structure like a martensite structure.

The method of production necessary and sufficient for introduction of dislocations into a steel material for expressing high temperature yield strength specifically comprises, first, for example, making the NbC, VC, TiC, ZrC, $Cr_{23}C_6$, or other various types of high temperature stable carbides completely dissolve by preheating the steel slab to a temperature of 1150° C. to 1300° C., then forging or otherwise hot working or rough rolling or final rolling or final working (forging) the slab, then limiting the rolling (working) end temperature to 880° C. or more so as to raise the subsequent accelerated cooling start temperature as much as possible and raise the apparent hardenability. Next, while the cooling rate differs for each location of the steel material depending on the thickness or shape of the steel material, the rolled (worked) steel material is acceleratedly cooled under conditions giving a cooling rate of 2° C./sec or more at the location where the cooling rate becomes the slowest such as the center of the plate thickness with thick gauge plate, the center position of the thick part with a steel shape and other complicatedly shaped forged member, or another minimum cooling rate location. Finally, to avoid an extreme rise in the density of dislocations in the structure, this cooling is managed by the measurement of the surface temperature of the steel material and stopped in the temperature region of 350 to 600° C., then the material is allowed to cool to obtain the optimum structure.

At this time, as the structure of the steel material, bainite becomes the main structure for achieving strength. Further, ferrite is sometimes partially formed, but basically the room temperature strength and high temperature yield strength are provided by the dislocations of the bainite structure. Further, under the high temperature environment envisioned at the time of a fire, the movement of the dislocations is suppressed by the cell structure which the precipitated carbides and dislocations form themselves. Note that in the present invention, the former is called "precipitation strengthening" while the latter is called "dislocation strengthening".

In this way, if combining limitations of the production conditions in addition to limitations of the chemical ingredients of the steel material (steel slab), it becomes possible to optimize the amount of addition of alloy with the best yield and produce a fire-resistant steel material excellent in high temperature yield strength.

Note that in the fire-resistant steel material of the present invention, the "necessary high temperature yield strength" in principle means ½ of the room temperature standard yield strength. For example, when there is a range to the yield strength of the steel material defined as the standard by the JIS etc., ½ of the lower limit value is made the necessary yield strength. Therefore, the required high temperature yield strength changes according to the room temperature strength. In tensile strength 400N/mm$^2$ class steel, it means ½ of the 235N/mm$^2$ of the lower limit value of room temperature yield strength, that is, 117N/mm$^2$ (rounded down at decimal point), while in tensile strength 500N/mm$^2$ class steel, it means ½ of the 325N/mm$^2$ of the room temperature yield strength, that is, 162N/mm$^2$. However, for 800° C. class fire-resistant steel material, since this high temperature can be said to be an extreme environment for a ferrite phase steel material, as the yardstick for the high temperature yield strength, 117N/mm$^2$ was defined as the necessary property of the steel material without regard as to the room temperature yield strength. These provisions in the present invention are not necessarily determined in any actual industrial standards and are values estimated by design calculations serving as guidelines including safety margins. In each case, a lower limit is set, but there is no upper limit.

EXAMPLES

Below, examples of the present invention will be explained. In the examples, steel slabs of the steel compositions shown in Table 1 and Table 2 were heated at the temperatures shown in Table 3 and Table 4 for 1 hour, then immediately roughly rolled to obtain steel plates of 100 mm thickness at 1050° C. After this, the plates were hot worked or hot rolled at end temperatures (finishing temperatures) of the temperatures shown in Table 3 and Table 4. Specifically, the steel slabs of No. 4, No. 7, No. 10, No. 14, No. 51, No. 68, and No. 80 were hot worked by forging to obtain steel shapes with complicated cross-sectional shapes of maximum thicknesses of 15 to 35 mm. On the other hand, the other steel slabs were hot rolled to obtain thick-gauge steel plates of finished thicknesses of 15 to 35 mm. Further, the slabs were acceleratedly cooled by water cooling at the rates shown in Table 3 and Table 4 targeting 500° C. right after hot working or hot rolling. At this time, a noncontact type thermometer or a thermocouple attached to part of the steel material is used to confirm the steel material surface temperature. When the surface temperature of the steel material becomes a temperature range of 500±50° C. at all locations, specifically, the surface temperature shown in Table 3 and Table 4, the accelerated cooling is stopped, then the material is allowed to cool to thereby prepare the steel material of the examples and comparative examples. Note that the balances in the steel compositions in Table 1 and Table 2 are Fe and unavoidable impurities. Further, the underlines in Table 2 and Table 4 show numerical values outside the scope of the present invention. Furthermore, the cooling rates shown in Table 3 and Table 4 are the average cooling rates at positions of the slowest cooling rates at the different steel materials.

TABLE 1

| | No. | Steel composition (mass %) | | | | | | | | | | |
|---|---|---|---|---|---|---|---|---|---|---|---|---|
| | | C | Si | Mn | Cr | P | S | V | Mo | Ni | Cu | N |
| Examples | 1 | 0.0220 | 0.50 | 0.29 | 3.89 | 0.005 | 0.0042 | 0.246 | 0.03 | 0.04 | 0.04 | 0.0022 |
| | 2 | 0.0127 | 0.31 | 0.36 | 3.28 | 0.003 | 0.0032 | 0.345 | 0.00 | 0.04 | 0.03 | 0.0013 |
| | 3 | 0.0151 | 0.22 | 0.33 | 4.02 | 0.007 | 0.0032 | 0.320 | 0.03 | 0.01 | 0.02 | 0.0025 |
| | 4 | 0.0196 | 0.05 | 0.22 | 2.54 | 0.011 | 0.0014 | 0.084 | 0.00 | 0.02 | 0.01 | 0.0033 |
| | 5 | 0.0267 | 0.25 | 0.08 | 3.57 | 0.008 | 0.0009 | 0.172 | 0.01 | 0.05 | 0.05 | 0.0026 |
| | 6 | 0.0147 | 0.31 | 0.20 | 3.38 | 0.007 | 0.0041 | 0.380 | 0.01 | 0.05 | 0.03 | 0.0033 |
| | 7 | 0.0148 | 0.21 | 0.17 | 2.65 | 0.004 | 0.0023 | 0.279 | 0.03 | 0.01 | 0.02 | 0.0033 |
| | 8 | 0.0154 | 0.33 | 0.13 | 4.13 | 0.003 | 0.0010 | 0.129 | 0.03 | 0.01 | 0.03 | 0.0037 |
| | 9 | 0.0075 | 0.35 | 0.36 | 3.49 | 0.005 | 0.0038 | 0.269 | 0.01 | 0.02 | 0.05 | 0.0034 |
| | 10 | 0.0160 | 0.43 | 0.24 | 4.26 | 0.004 | 0.0042 | 0.111 | 0.03 | 0.05 | 0.05 | 0.0019 |
| | 11 | 0.0092 | 0.04 | 0.17 | 1.99 | 0.009 | 0.0020 | 0.101 | 0.02 | 0.01 | 0.03 | 0.0013 |
| | 12 | 0.0177 | 0.07 | 0.26 | 2.37 | 0.004 | 0.0003 | 0.397 | 0.00 | 0.04 | 0.01 | 0.0035 |
| | 13 | 0.0267 | 0.39 | 0.05 | 3.84 | 0.011 | 0.0017 | 0.349 | 0.00 | 0.06 | 0.02 | 0.0012 |
| | 14 | 0.0187 | 0.38 | 0.26 | 2.24 | 0.005 | 0.0042 | 0.407 | 0.00 | 0.03 | 0.04 | 0.0013 |
| | 15 | 0.0192 | 0.04 | 0.17 | 3.63 | 0.004 | 0.0023 | 0.185 | 0.02 | 0.00 | 0.02 | 0.0021 |
| | 16 | 0.0220 | 0.29 | 0.26 | 1.86 | 0.007 | 0.0013 | 0.424 | 0.01 | 0.01 | 0.04 | 0.0031 |
| | 17 | 0.0084 | 0.20 | 0.05 | 1.93 | 0.009 | 0.0012 | 0.162 | 0.01 | 0.06 | 0.03 | 0.0037 |
| | 18 | 0.0220 | 0.17 | 0.28 | 3.72 | 0.009 | 0.0008 | 0.256 | 0.01 | 0.07 | 0.05 | 0.0012 |
| | 19 | 0.0147 | 0.45 | 0.06 | 3.98 | 0.011 | 0.0039 | 0.067 | 0.01 | 0.06 | 0.03 | 0.0030 |
| | 20 | 0.0080 | 0.26 | 0.05 | 1.90 | 0.011 | 0.0038 | 0.245 | 0.03 | 0.02 | 0.05 | 0.0033 |
| | 21 | 0.0053 | 0.04 | 0.29 | 4.17 | 0.008 | 0.0022 | 0.255 | 0.03 | 0.07 | 0.03 | 0.0035 |
| | 22 | 0.0164 | 0.45 | 0.28 | 4.43 | 0.010 | 0.0020 | 0.325 | 0.00 | 0.00 | 0.04 | 0.0013 |
| | 23 | 0.0177 | 0.15 | 0.24 | 3.00 | 0.005 | 0.0009 | 0.118 | 0.02 | 0.04 | 0.02 | 0.0027 |
| | 24 | 0.0209 | 0.19 | 0.12 | 4.23 | 0.003 | 0.0043 | 0.187 | 0.02 | 0.07 | 0.04 | 0.0045 |
| | 25 | 0.0195 | 0.29 | 0.12 | 4.12 | 0.002 | 0.0025 | 0.444 | 0.00 | 0.05 | 0.03 | 0.0016 |
| | 26 | 0.0128 | 0.33 | 0.16 | 2.23 | 0.003 | 0.0018 | 0.203 | 0.01 | 0.03 | 0.01 | 0.0028 |
| | 27 | 0.0073 | 0.13 | 0.11 | 2.54 | 0.004 | 0.0042 | 0.220 | 0.00 | 0.05 | 0.05 | 0.0028 |
| | 28 | 0.0267 | 0.03 | 0.09 | 2.08 | 0.005 | 0.0007 | 0.334 | 0.00 | 0.05 | 0.04 | 0.0019 |
| | 29 | 0.0225 | 0.35 | 0.15 | 2.88 | 0.011 | 0.0010 | 0.263 | 0.02 | 0.04 | 0.04 | 0.0020 |
| | 30 | 0.0271 | 0.08 | 0.09 | 3.77 | 0.007 | 0.0042 | 0.186 | 0.01 | 0.03 | 0.03 | 0.0031 |
| | 31 | 0.0241 | 0.24 | 0.40 | 2.26 | 0.003 | 0.0035 | 0.124 | 0.01 | 0.07 | 0.02 | 0.0028 |
| | 32 | 0.0093 | 0.26 | 0.27 | 2.23 | 0.008 | 0.0020 | 0.129 | 0.01 | 0.00 | 0.04 | 0.0036 |
| | 33 | 0.0140 | 0.21 | 0.16 | 1.51 | 0.004 | 0.0035 | 0.157 | 0.02 | 0.01 | 0.04 | 0.0028 |
| | 34 | 0.0264 | 0.15 | 0.31 | 1.63 | 0.006 | 0.0039 | 0.117 | 0.01 | 0.03 | 0.05 | 0.0036 |
| | 35 | 0.0053 | 0.43 | 0.08 | 4.00 | 0.003 | 0.0003 | 0.107 | 0.02 | 0.00 | 0.04 | 0.0011 |
| | 36 | 0.0164 | 0.34 | 0.25 | 3.72 | 0.006 | 0.0008 | 0.226 | 0.02 | 0.05 | 0.02 | 0.0027 |
| | 37 | 0.0290 | 0.45 | 0.27 | 1.54 | 0.009 | 0.0027 | 0.118 | 0.03 | 0.00 | 0.01 | 0.0033 |

| | No. | Steel composition (mass %) | | | | | | | | | | |
|---|---|---|---|---|---|---|---|---|---|---|---|---|
| | | B | O | Ti | Zr | Nb | Ca | Mg | Y | Ce | La | [Nb] × [C] |
| Examples | 1 | 0.0001 | 0.0040 | — | — | — | — | — | — | — | — | — |
| | 2 | 0.0002 | 0.0021 | — | — | — | — | — | — | — | — | — |
| | 3 | 0.0001 | 0.0024 | — | — | — | — | — | — | — | — | — |
| | 4 | 0.0001 | 0.0025 | — | — | — | — | — | — | — | — | — |
| | 5 | 0.0000 | 0.0031 | — | — | — | — | — | — | — | — | — |
| | 6 | 0.0001 | 0.0051 | — | — | — | — | — | — | — | — | — |
| | 7 | 0.0001 | 0.0033 | — | — | — | — | — | — | — | — | — |
| | 8 | 0.0001 | 0.0015 | — | — | — | — | — | — | — | — | — |
| | 9 | 0.0001 | 0.0043 | — | — | — | — | — | — | — | — | — |
| | 10 | 0.0001 | 0.0012 | — | — | — | — | — | — | — | — | — |
| | 11 | 0.0002 | 0.0024 | 0.0120 | — | — | — | — | — | — | — | — |
| | 12 | 0.0001 | 0.0010 | 0.0110 | 0.0080 | — | — | — | — | — | — | — |
| | 13 | 0.0002 | 0.0019 | — | 0.0120 | — | — | — | — | — | — | — |
| | 14 | 0.0001 | 0.0015 | — | — | 0.0160 | — | — | — | — | — | 0.0003 |
| | 15 | 0.0002 | 0.0011 | — | — | 0.0760 | — | — | — | — | — | 0.0015 |
| | 16 | 0.0001 | 0.0017 | 0.0070 | — | 0.1220 | — | — | — | — | — | 0.0027 |
| | 17 | 0.0001 | 0.0031 | — | — | 0.1640 | — | — | — | — | — | 0.0014 |
| | 18 | 0.0001 | 0.0034 | 0.0280 | — | 0.2120 | — | — | — | — | — | 0.0047 |
| | 19 | 0.0001 | 0.0040 | — | — | 0.2650 | — | — | — | — | — | 0.0039 |
| | 20 | 0.0001 | 0.0026 | — | — | 0.2710 | — | — | — | — | — | 0.0022 |
| | 21 | 0.0001 | 0.0022 | 0.0420 | — | — | — | — | — | — | — | — |
| | 22 | 0.0001 | 0.0012 | — | — | — | 0.0023 | — | — | — | — | — |
| | 23 | 0.0001 | 0.0048 | — | — | — | — | 0.0032 | — | — | — | — |
| | 24 | 0.0000 | 0.0012 | — | — | — | — | — | 0.016 | — | — | — |
| | 25 | 0.0001 | 0.0054 | — | — | — | — | — | — | 0.019 | — | — |
| | 26 | 0.0000 | 0.0034 | — | — | — | — | — | — | — | 0.027 | — |
| | 27 | 0.0001 | 0.0035 | 0.0160 | — | — | 0.0018 | — | — | — | — | — |
| | 28 | 0.0001 | 0.0014 | 0.0120 | — | — | — | 0.0019 | — | — | — | — |
| | 29 | 0.0002 | 0.0016 | 0.0180 | — | — | — | — | 0.027 | — | — | — |
| | 30 | 0.0001 | 0.0037 | — | 0.0120 | — | 0.0026 | — | — | — | — | — |
| | 31 | 0.0000 | 0.0054 | — | 0.0260 | — | — | 0.0023 | — | — | — | — |
| | 32 | 0.0000 | 0.0006 | — | 0.0190 | — | — | — | — | — | — | — |
| | 33 | 0.0000 | 0.0037 | — | — | 0.0250 | 0.0026 | — | — | — | — | 0.0004 |
| | 34 | 0.0001 | 0.0046 | — | — | 0.0690 | 0.0018 | — | — | 0.016 | — | 0.0018 |

TABLE 1-continued

| | | | | | | | | | | | |
|---|---|---|---|---|---|---|---|---|---|---|---|
| 35 | 0.0000 | 0.0023 | — | — | 0.1500 | 0.0019 | — | — | — | 0.018 | 0.0008 |
| 36 | 0.0001 | 0.0047 | — | — | 0.2200 | 0.0023 | — | — | — | — | 0.0036 |
| 37 | 0.0001 | 0.0012 | — | — | 0.2000 | — | 0.0017 | — | — | — | 0.0058 |

TABLE 2

| | | Steel composition (mass %) | | | | | | | | | | | | |
|---|---|---|---|---|---|---|---|---|---|---|---|---|---|---|
| | No. | C | Si | Mn | Cr | P | S | V | Mo | Ni | Cu | N | B | O |
| Comp. ex. | 51 | 0.0040 | 0.41 | 0.26 | 2.30 | 0.004 | 0.0042 | 0.428 | 0.03 | 0.05 | 0.05 | 0.0034 | 0.0001 | 0.0008 |
| | 52 | 0.0460 | 0.02 | 0.18 | 1.64 | 0.005 | 0.0015 | 0.344 | 0.03 | 0.03 | 0.05 | 0.0030 | 0.0001 | 0.0007 |
| | 53 | 0.0248 | 0.03 | 0.13 | 3.90 | 0.011 | 0.0024 | 0.143 | 0.02 | 0.01 | 0.03 | 0.0029 | 0.0000 | 0.0030 |
| | 54 | 0.0117 | 0.15 | 1.21 | 1.84 | 0.007 | 0.0034 | 0.426 | 0.01 | 0.05 | 0.05 | 0.0017 | 0.0002 | 0.0007 |
| | 55 | 0.0273 | 0.49 | 0.37 | 7.81 | 0.007 | 0.0041 | 0.387 | 0.03 | 0.03 | 0.01 | 0.0026 | 0.0000 | 0.0014 |
| | 56 | 0.0282 | 0.23 | 0.15 | 1.02 | 0.007 | 0.0007 | 0.271 | 0.02 | 0.05 | 0.04 | 0.0021 | 0.0002 | 0.0013 |
| | 57 | 0.0176 | 0.39 | 0.32 | 3.81 | 0.005 | 0.0040 | 0.560 | 0.02 | 0.02 | 0.04 | 0.0032 | 0.0001 | 0.0013 |
| | 58 | 0.0177 | 0.32 | 0.09 | 2.83 | 0.009 | 0.0006 | 0.259 | 0.32 | 0.00 | 0.01 | 0.0042 | 0.0001 | 0.0015 |
| | 59 | 0.0112 | 0.50 | 0.34 | 3.36 | 0.005 | 0.0015 | 0.135 | 0.02 | 0.46 | 0.05 | 0.0025 | 0.0000 | 0.0016 |
| | 60 | 0.0118 | 0.47 | 0.06 | 3.50 | 0.007 | 0.0032 | 0.225 | 0.03 | 0.06 | 0.55 | 0.0021 | 0.0001 | 0.0012 |
| | 61 | 0.0055 | 0.18 | 0.18 | 3.10 | 0.006 | 0.0009 | 0.094 | 0.02 | 0.06 | 0.04 | 0.0065 | 0.0002 | 0.0044 |
| | 62 | 0.0175 | 0.26 | 0.15 | 3.77 | 0.008 | 0.0011 | 0.129 | 0.01 | 0.02 | 0.05 | 0.0026 | 0.0028 | 0.0025 |
| | 63 | 0.0119 | 0.37 | 0.23 | 3.16 | 0.010 | 0.0024 | 0.198 | 0.01 | 0.05 | 0.03 | 0.0041 | 0.0001 | 0.0120 |
| | 64 | 0.0285 | 0.37 | 0.32 | 1.70 | 0.007 | 0.0033 | 0.238 | 0.02 | 0.07 | 0.03 | 0.0045 | 0.0001 | 0.0055 |
| | 65 | 0.0299 | 0.25 | 0.22 | 2.49 | 0.004 | 0.0022 | 0.152 | 0.00 | 0.00 | 0.00 | 0.0028 | 0.0000 | 0.0025 |
| | 66 | 0.0133 | 0.04 | 0.40 | 2.92 | 0.026 | 0.0034 | 0.341 | 0.02 | 0.07 | 0.04 | 0.0043 | 0.0001 | 0.0010 |
| | 67 | 0.0095 | 0.21 | 0.36 | 2.85 | 0.005 | 0.0092 | 0.121 | 0.02 | 0.03 | 0.01 | 0.0019 | 0.0001 | 0.0011 |
| | 68 | 0.0093 | 0.06 | 0.34 | 1.72 | 0.012 | 0.0019 | 0.449 | 0.01 | 0.01 | 0.05 | 0.0032 | 0.0002 | 0.0043 |
| | 69 | 0.0265 | 0.21 | 0.13 | 3.75 | 0.005 | 0.0035 | 0.066 | 0.01 | 0.07 | 0.02 | 0.0016 | 0.0001 | 0.0049 |
| | 70 | 0.0213 | 0.09 | 0.12 | 3.35 | 0.011 | 0.0027 | 0.418 | 0.01 | 0.03 | 0.02 | 0.0034 | 0.0001 | 0.0027 |
| | 71 | 0.0266 | 0.41 | 0.25 | 4.50 | 0.007 | 0.0014 | 0.435 | 0.03 | 0.05 | 0.02 | 0.0035 | 0.0000 | 0.0042 |
| | 72 | 0.0130 | 0.25 | 0.06 | 1.97 | 0.010 | 0.0029 | 0.197 | 0.01 | 0.01 | 0.03 | 0.0026 | 0.0001 | 0.0028 |
| | 73 | 0.0195 | 0.22 | 0.09 | 2.87 | 0.003 | 0.0023 | 0.424 | 0.01 | 0.00 | 0.03 | 0.0016 | 0.0001 | 0.0053 |
| | 74 | 0.0140 | 0.29 | 0.26 | 1.56 | 0.007 | 0.0006 | 0.182 | 0.01 | 0.00 | 0.02 | 0.0040 | 0.0002 | 0.0054 |
| | 75 | 0.0052 | 0.04 | 0.13 | 3.50 | 0.007 | 0.0041 | 0.117 | 0.00 | 0.02 | 0.05 | 0.0021 | 0.0002 | 0.0008 |
| | 76 | 0.0070 | 0.04 | 0.12 | 2.19 | 0.007 | 0.0040 | 0.378 | 0.01 | 0.02 | 0.04 | 0.0024 | 0.0001 | 0.0030 |
| | 77 | 0.0065 | 0.50 | 0.17 | 3.52 | 0.008 | 0.0041 | 0.143 | 0.01 | 0.04 | 0.03 | 0.0040 | 0.0001 | 0.0031 |
| | 78 | 0.0070 | 0.29 | 0.18 | 2.23 | 0.010 | 0.0010 | 0.219 | 0.01 | 0.02 | 0.03 | 0.0022 | 0.0001 | 0.0041 |
| | 79 | 0.0061 | 0.03 | 0.13 | 2.83 | 0.005 | 0.0042 | 0.232 | 0.03 | 0.00 | 0.02 | 0.0028 | 0.0001 | 0.0044 |
| | 80 | 0.0066 | 0.17 | 0.11 | 1.99 | 0.008 | 0.0033 | 0.321 | 0.01 | 0.02 | 0.01 | 0.0026 | 0.0002 | 0.0019 |

| | | Steel composition (mass %) | | | | | | | | |
|---|---|---|---|---|---|---|---|---|---|---|
| | No. | Ti | Zr | Nb | Ca | Mg | Y | Ce | La | [Nb] × [C] |
| Comp. ex. | 51 | — | — | — | — | — | — | — | — | — |
| | 52 | — | — | — | — | — | — | — | — | — |
| | 53 | — | — | — | — | — | — | — | — | — |
| | 54 | — | — | — | — | — | — | — | — | — |
| | 55 | — | — | — | — | — | — | — | — | — |
| | 56 | — | — | — | — | — | — | — | — | — |
| | 57 | — | — | — | — | — | — | — | — | — |
| | 58 | — | — | — | — | — | — | — | — | — |
| | 59 | — | — | — | — | — | — | — | — | — |
| | 60 | — | — | — | — | — | — | — | — | — |
| | 61 | 0.0120 | — | — | — | — | — | — | — | — |
| | 62 | 0.0110 | 0.0080 | — | — | — | — | — | — | — |
| | 63 | — | 0.0070 | — | — | — | — | — | — | — |
| | 64 | — | — | 0.3820 | — | — | — | — | — | 0.0109 |
| | 65 | — | — | 0.2900 | — | — | — | — | — | 0.0087 |
| | 66 | — | — | 0.0760 | — | — | — | — | — | 0.0010 |
| | 67 | 0.0070 | — | 0.1220 | — | — | — | — | — | 0.0012 |
| | 68 | 0.0810 | — | — | — | — | | — | — | — |
| | 69 | — | 0.0260 | — | — | — | — | — | — | — |
| | 70 | — | — | — | 0.0062 | — | — | — | — | — |
| | 71 | — | — | — | — | 0.0071 | — | — | — | — |
| | 72 | — | — | — | — | — | 0.0990 | — | — | — |
| | 73 | — | — | — | — | — | — | 0.0760 | — | — |
| | 74 | — | — | — | — | — | — | — | 0.0825 | — |
| | 75 | — | — | — | — | — | — | — | — | — |
| | 76 | — | — | — | — | — | — | — | — | — |
| | 77 | — | — | — | — | — | — | — | — | — |
| | 78 | — | — | — | — | — | — | — | — | — |
| | 79 | — | — | — | — | — | — | — | — | — |
| | 80 | — | — | — | — | — | — | — | — | — |

TABLE 3

| | No. | Heating temperature before rolling and working (° C.) | Rolling and working finishing temperature (° C.) | Average cooling rate of accelerated cooling (° C./sec) | Accelerated cooling stop temperature (° C.) |
|---|---|---|---|---|---|
| Example | 1 | 1200 | 900 | 2 | 480 |
| | 2 | 1200 | 920 | 13 | 510 |
| | 3 | 1200 | 910 | 4 | 520 |
| | 4 | 1200 | 1010 | 21 | 470 |
| | 5 | 1250 | 910 | 21 | 480 |
| | 6 | 1250 | 960 | 13 | 450 |
| | 7 | 1250 | 1010 | 7 | 480 |
| | 8 | 1250 | 920 | 6 | 450 |
| | 9 | 1250 | 910 | 20 | 460 |
| | 10 | 1250 | 1010 | 5 | 450 |
| | 11 | 1280 | 910 | 10 | 520 |
| | 12 | 1280 | 910 | 8 | 470 |
| | 13 | 1220 | 910 | 14 | 520 |
| | 14 | 1220 | 1010 | 17 | 450 |
| | 15 | 1250 | 960 | 19 | 470 |
| | 16 | 1250 | 930 | 11 | 490 |
| | 17 | 1250 | 1000 | 16 | 540 |
| | 18 | 1250 | 1000 | 19 | 480 |
| | 19 | 1250 | 900 | 8 | 490 |
| | 20 | 1250 | 950 | 13 | 480 |
| | 21 | 1200 | 930 | 7 | 450 |
| | 22 | 1200 | 1000 | 12 | 460 |
| | 23 | 1200 | 1000 | 5 | 450 |
| | 24 | 1200 | 920 | 14 | 520 |
| | 25 | 1200 | 960 | 3 | 460 |
| | 26 | 1200 | 990 | 16 | 540 |
| | 27 | 1200 | 950 | 5 | 450 |
| | 28 | 1200 | 940 | 21 | 480 |
| | 29 | 1200 | 960 | 5 | 470 |
| | 30 | 1150 | 960 | 7 | 490 |
| | 31 | 1150 | 970 | 15 | 460 |
| | 32 | 1150 | 910 | 16 | 470 |
| | 33 | 1250 | 940 | 4 | 500 |
| | 34 | 1250 | 910 | 15 | 500 |
| | 35 | 1220 | 900 | 14 | 460 |
| | 36 | 1220 | 990 | 10 | 480 |
| | 37 | 1220 | 930 | 16 | 470 |

TABLE 4

| | No. | Heating temperature before rolling and working (° C.) | Rolling and working finishing temperature (° C.) | Average cooling rate of accelerated cooling (° C./sec) | Accelerated cooling stop temperature (° C.) |
|---|---|---|---|---|---|
| Comp. ex. | 51 | 1200 | 1010 | 17 | 450 |
| | 52 | 1200 | 940 | 18 | 470 |
| | 53 | 1200 | 1000 | 3 | 490 |
| | 54 | 1220 | 940 | 16 | 510 |
| | 55 | 1220 | 1000 | 10 | 490 |
| | 56 | 1220 | 920 | 9 | 530 |
| | 57 | 1220 | 950 | 11 | 520 |
| | 58 | 1220 | 910 | 18 | 540 |
| | 59 | 1250 | 990 | 16 | 510 |
| | 60 | 1250 | 910 | 20 | 480 |
| | 61 | 1250 | 940 | 5 | 460 |
| | 62 | 1250 | 940 | 10 | 510 |
| | 63 | 1250 | 930 | 19 | 500 |
| | 64 | 1180 | 960 | 17 | 520 |
| | 65 | 1220 | 910 | 4 | 480 |
| | 66 | 1250 | 1000 | 15 | 530 |
| | 67 | 1180 | 900 | 21 | 450 |
| | 68 | 1200 | 1010 | 19 | 460 |
| | 69 | 1180 | 950 | 16 | 490 |
| | 70 | 1180 | 960 | 10 | 480 |
| | 71 | 1180 | 960 | 15 | 460 |
| | 72 | 1180 | 980 | 13 | 480 |
| | 73 | 1180 | 990 | 21 | 480 |

TABLE 4-continued

| No. | Heating temperature before rolling and working (° C.) | Rolling and working finishing temperature (° C.) | Average cooling rate of accelerated cooling (° C./sec) | Accelerated cooling stop temperature (° C.) |
|---|---|---|---|---|
| 74 | 1180 | 910 | 11 | 540 |
| 75 | 1080 | 860 | 4 | 490 |
| 76 | 1360 | 930 | 5 | 450 |
| 77 | 1220 | 780 | 4 | 530 |
| 78 | 1200 | 980 | 1 | 480 |
| 79 | 1200 | 910 | 13 | 700 |
| 80 | 1200 | 1010 | 20 | 220 |

Next, the steel materials of the examples and comparative examples prepared by the above-mentioned method were evaluated for room temperature yield strength, high temperature yield strength, and reheat embrittlement of a joint serving as the indicator for judging the embrittlement of HAZ of the welded joint after a fire. The room temperature yield strength (YS (RT)) was evaluated by cutting out a test piece from each steel material, conducting a tensile test at room temperature based on the tensile test method defined in JIS Z 2241, and determining the upper yield point when an upper yield point clearly appears on a stress-strain graph and the 0.2% yield strength when it does not appear. Further, the high temperature yield strengths at 700° C., 750° C., and 800° C. (YS (700), YS (750), and YS (800)) were evaluated by obtaining high temperature tensile test pieces of diameters of parallel parts of 6 mm and lengths of parallel parts of 30 mm defined by JIS G 0567 from the steel materials of the examples and comparative examples, performing high temperature tensile tests under conditions of temperatures of 700° C., 750° C., and 800° C., breaking the pieces at a tensile strain rate of 5%/hour, and preparing stress-strain graphs from the results. The yield strengths in this case were all 0.2% yield strength. Furthermore, the HAZ toughness was determined by cutting out a No. 4 impact test piece given a 2 mm V-notch based on JIS Z 2242 from each steel material, running a Charpy impact test at 0° C., and evaluating it by the measured absorption energy ($vE_0$-B). At this time, the threshold value of the HAZ toughness was made 27 J considering the earthquake resistance of building structures.

Furthermore, the reheat embrittlement of HAZ of the welded joint was determined by forming a 45 degree X-groove in each steel material of the examples and comparative examples, then forming a joint by welding by three or more layers of TIG welding or SAW welding by an input heat of 5 to 20 kJ/mm without pre/post-heating, raising the welded joint in temperature as a whole to various types of temperature of 700 to 800° C. in 1 hour, holding it at that temperature for 1 hour, then allowing it to cool and evaluating it by a Charpy test. Specifically, a No. 4 impact test piece given a 2 mm V-notch based on JIS Z 2242 was cut out at the fusion line from the joined part of each welded joint and the absorption energy ($vE_0$-W) at 0° C. was measured. At that time, the threshold value was made 27 J in the same way as the matrix (steel material). The above results are shown in Table 5 and Table 6. Note that the following Table 5 and Table 6 show, as reference data, the $Ac_1$ transformation point of the steel material determined by the linear expansion measurement method with a rate of temperature rise of 2.5° C./min.

TABLE 5

| | No. | Mechanical properties | | | | | | |
|---|---|---|---|---|---|---|---|---|
| | | YS (RT) ($N/mm^2$) | YS (700) ($N/mm^2$) | YS (750) ($N/mm^2$) | YS (800) ($N/mm^2$) | $vE_0$-B (J) | $vE_0$-W (J) | $Ac_1$ (° C.) |
| Example | 1 | 328 | 159 | 125 | — | 287 | 181 | 812 |
| | 2 | 346 | 266 | 164 | 133 | 112 | 167 | 861 |
| | 3 | 346 | 281 | 179 | 119 | 251 | 191 | 852 |
| | 4 | 262 | 181 | 141 | — | 336 | 198 | 802 |
| | 5 | 302 | 190 | 149 | — | 343 | 121 | 806 |
| | 6 | 358 | 226 | 152 | 118 | 303 | 130 | 851 |
| | 7 | 319 | 177 | 123 | — | 266 | 155 | 813 |
| | 8 | 290 | 135 | — | — | 319 | 146 | 787 |
| | 9 | 323 | 198 | 125 | — | 132 | 135 | 811 |
| | 10 | 287 | 128 | — | — | 336 | 122 | 796 |
| | 11 | 257 | 118 | — | — | 151 | 89 | 794 |
| | 12 | 354 | 255 | 163 | 128 | 343 | 88 | 850 |
| | 13 | 359 | 260 | 165 | 117 | 321 | 74 | 852 |
| | 14 | 359 | 262 | 168 | 120 | 266 | 51 | 853 |
| | 15 | 310 | 181 | 170 | — | 162 | 46 | 831 |
| | 16 | 373 | 283 | 177 | 125 | 157 | 36 | 855 |
| | 17 | 290 | 166 | — | — | 118 | 67 | 779 |
| | 18 | 351 | 249 | 164 | — | 290 | 70 | 801 |
| | 19 | 396 | 316 | 242 | 189 | 207 | 81 | 812 |
| | 20 | 385 | 308 | 251 | 177 | 119 | 90 | 831 |
| | 21 | 327 | 218 | 165 | 119 | 85 | 133 | 855 |
| | 22 | 354 | 285 | 193 | 155 | 79 | 125 | 854 |
| | 23 | 276 | 165 | — | — | 166 | 128 | 861 |
| | 24 | 310 | 213 | 165 | — | 261 | 131 | 841 |
| | 25 | 386 | 303 | 225 | 173 | 209 | 115 | 855 |
| | 26 | 292 | 218 | 169 | — | 200 | 141 | 840 |
| | 27 | 298 | 225 | 165 | — | 151 | 160 | 835 |
| | 28 | 336 | 268 | 185 | 121 | 313 | 113 | 852 |
| | 29 | 323 | 213 | 165 | — | 316 | 107 | 843 |
| | 30 | 308 | 195 | 164 | — | 388 | 160 | 835 |
| | 31 | 275 | 180 | — | — | 361 | 121 | 802 |
| | 32 | 268 | 165 | — | — | 166 | 161 | 795 |
| | 33 | 273 | 166 | — | — | 186 | 122 | 789 |
| | 34 | 274 | 170 | — | — | 313 | 68 | 799 |
| | 35 | 292 | 227 | 165 | — | 57 | 54 | 825 |
| | 36 | 338 | 281 | 166 | 135 | 122 | 164 | 851 |
| | 37 | 349 | 266 | 206 | 125 | 316 | 151 | 855 |

TABLE 6

| | No. | Mechanical properties | | | | | | |
|---|---|---|---|---|---|---|---|---|
| | | YS (RT) ($N/mm^2$) | YS (700) ($N/mm^2$) | YS (750) ($N/mm^2$) | YS (800) ($N/mm^2$) | $vE_0$-B (J) | $vE_0$-W (J) | $Ac_1$ (° C.) |
| Comp. ex. | 51 | 215 | 68 | — | — | 168 | 162 | 812 |
| | 52 | 561 | 252 | — | — | 18 | 151 | 751 |
| | 53 | 299 | 207 | — | — | 11 | 160 | 755 |
| | 54 | 484 | 103 | — | — | 98 | 153 | 731 |
| | 55 | 712 | 315 | 224 | 145 | 12 | 15 | 842 |
| | 56 | 266 | 107 | — | — | 21 | 18 | 851 |
| | 57 | 699 | 114 | — | — | 24 | 15 | 813 |
| | 58 | 341 | 223 | — | — | 215 | 12 | 822 |
| | 59 | 414 | 103 | — | — | 198 | 61 | 741 |
| | 60 | 298 | 105 | — | — | 57 | 128 | 733 |
| | 61 | 313 | 115 | — | — | 23 | 155 | 794 |
| | 62 | 398 | 284 | 161 | — | 202 | 7 | 831 |
| | 63 | 312 | 251 | 181 | 122 | 189 | 12 | 825 |
| | 64 | 425 | 299 | 195 | 128 | 13 | 5 | 814 |
| | 65 | 489 | 312 | 198 | 131 | 89 | 3 | 848 |
| | 66 | 318 | 199 | — | — | 14 | 9 | 798 |
| | 67 | 346 | 245 | 169 | — | 11 | 7 | 802 |
| | 68 | 335 | 148 | — | — | 7 | 11 | 778 |
| | 69 | 311 | 144 | — | — | 4 | 84 | 781 |
| | 70 | 285 | 197 | — | — | 9 | 91 | 804 |
| | 71 | 299 | 198 | — | — | 12 | 121 | 812 |
| | 72 | 312 | 166 | — | — | 9 | 100 | 806 |
| | 73 | 303 | 181 | — | — | 21 | 81 | 821 |
| | 74 | 288 | 195 | — | — | 24 | 97 | 815 |

TABLE 6-continued

| | Mechanical properties | | | | | | |
|---|---|---|---|---|---|---|---|
| No. | YS (RT) (N/mm$^2$) | YS (700) (N/mm$^2$) | YS (750) (N/mm$^2$) | YS (800) (N/mm$^2$) | $vE_0$-B (J) | $vE_0$-W (J) | $Ac_1$ (° C.) |
| 75 | 292 | 165 | — | — | 212 | 123 | 766 |
| 76 | 361 | 254 | 168 | — | 13 | 122 | 812 |
| 77 | 288 | 115 | — | — | 268 | 106 | 784 |
| 78 | 277 | 105 | — | — | 289 | 127 | 789 |
| 79 | 236 | 151 | — | — | 312 | 199 | 791 |
| 80 | 422 | 324 | 262 | 181 | 6 | 122 | 861 |

The steel materials of No. 1 to No. 37 shown in Table 5 are examples of the present invention where the various types of temperature of 700 to 800° C. become the envisioned fire temperature. The applied temperatures were classified into classes of 50° C. each to obtain a 700° C. class, 750° C. class, and 800° C. class. In the table, the highest temperature among the values of the high temperature yield strengths shown is made the highest endurance temperature. For this reason, temperatures not entered in the column of high temperature yield strength are outside the range of the specifications of the steel materials. As shown in Table 5, the steel materials of Example No. 1 to No. 37 had a high temperature yield strength at the highest endurance temperature of 117N/mm$^2$ or more when the room temperature yield strength (YS (RT)) was 235N/mm$^2$ or more and had a high temperature yield strength at the highest endurance temperature of 162N/mm$^2$ or more when the room temperature yield strength (YS (RT)) was 325N/mm$^2$ or more. Further, the steel materials of No. 1 to No. 37 had Charpy absorption energies of 47 J or more at 0° C. at both the matrix (steel material) and welded joint. From the above results, the steel materials of Example No. 1 to No. 37 produced in the scope of the present invention all satisfy the required high temperature property. It was confirmed that the toughness of the steel materials and the HAZ toughness of the welded joints after heat treatment satisfied the required performance.

On the other hand, the steel materials of Comparative Example No. 51 to No. 80 produced under conditions outside the range of the present invention were inferior to the steel materials of the above examples in room temperature yield strength, high temperature yield strength, toughness, or HAZ toughness of the welded joint after heat treatment. Specifically, the steel material of Comparative Example No. 51 had a C content smaller than the range of the present invention and failed to have sufficient dislocations introduced into the structure, so the amount of the carbides themselves became smaller and further the amount of carbides precipitated in the grains on the dislocations also was reduced, so the 700° C. high temperature yield strength (YS (700)) was low. Further, the steel material of Comparative Example No. 52 had an excessive C content, so while the high temperature yield strength was secured, the precipitation of the Cr-based coarse carbides resulted in a drop of toughness of the steel material. Further, the steel material of Comparative Example No. 53 had a small amount of addition of Si and insufficient deoxidation, so clusters of Mn-based oxides formed and the toughness of the steel material dropped. Further, the steel material of Comparative Example No. 54 had an excessive amount of Mn added, so the transformation point remarkably dropped and as a result the high temperature yield strength dropped. Further, the steel material of Comparative Example No. 55 had an excessive amount of addition of Cr, so the structure included a martensite structure and the hardenability became high and the room temperature strength became too high and, as a result, while the high temperature yield strength was maintained high, the toughness of the steel material and the HAZ toughness of the welded joint after heat treatment equivalent to a fire dropped. On the other hand, the steel material of Comparative Example No. 56 is insufficient in amount of addition of Cr, so the hardenability dropped and the 700° C. high temperature yield strength (YS (700)) dropped.

The steel material of Comparative Example No. 57 had too large an amount of V, so coarse VC carbides are formed and conversely the 700° C. high temperature yield strength (YS (700)) dropped. Further, the steel material of Comparative Example No. 58 had excessive Mo added, so while the 700° C. high temperature yield strength (YS (700)) was secured, the welded joint became embrittled after heat treatment envisioning a fire. Further, the steel material of Comparative Example No. 59 had Ni intermixed in an excessive content, so the transformation point dropped and the 700° C. high temperature yield strength (YS (700)) dropped. Further, the steel material of Comparative Example No. 60 had Cu added, so the content ended up exceeding the range of the present invention and, in the same way as Ni, the transformation point dropped and the 700° C. high temperature yield strength (YS (700)) dropped. Further, the steel material of Comparative Example No. 61 had an excessive N content, so coarse nitrides were formed and both the 700° C. high temperature yield strength (YS (700)) and toughness of the steel material dropped. Further, the steel material of Comparative Example No. 62 had B added, so the content exceeded the range of the present invention. Up to 750° C., the high temperature yield strength exceeded the threshold value, but the welded joint became embrittled after the heat treatment envisioning a fire. Further, the steel material of Comparative Example No. 63 had a high 0 content, so oxide clusters formed and the toughness of the steel material dropped.

The steel material of Comparative Example No. 64 had too great an Nb content, so the product of the Nb content and the C content ([Nb]×[C]) became 0.007 or more, the toughness of the steel material fell, and HAZ of the welded joint became embrittled after heat treatment envisioning a fire. Further, the steel material of Comparative Example No. 65 had an Nb content and C content in the range of the present invention, but had a product of the Nb content and the C content ([Nb]×[C]) of 0.007 or more, so the welded joint became embrittled after the heat treatment envisioning a fire. Further, the steel material of Comparative Example No. 66 had a high P content, while the steel material of Comparative Example No. 67 had a high S content. In both cases, the toughness of the steel material dropped, and HAZ of the welded joint became embrittled after heat treatment envisioning a fire. Further, the steel material of Comparative Example No. 68 had too large an amount of addition of Ti, so the toughness of the steel material dropped and the welded joint became embrittled after heat treatment envisioning a fire. Further, the steel material of Comparative Example No. 69 had too great an amount of addition of Zr, so the Zr carbides coarsened and precipitated in a large amount whereby other carbides were no longer formed, the 700° C. high temperature yield strength (YS (700)) dropped, and, furthermore, the toughness of the steel material also dropped. The steel material of Comparative Example No. 70 had an excessive Ca content, the steel material of Comparative Example No. 71 an excessive Mg content, the steel material of Comparative Example No. 72 an excessive Y content, the steel material of Comparative Example No. 73 an excessive Ce content, and the steel material of Comparative Example No. 74 an excessive La content, so in each case oxide clusters formed and the toughness of the steel material dropped.

The steel material of Comparative Example No. 75 had a low preheating temperature before rolling, so as a result the rolling end temperature dropped and, while the chemical ingredients satisfied the conditions of the present invention, the 700° C. high temperature yield strength (YS (700)) could not be stably achieved. Further, the steel material of Comparative Example No. 76 had too high a preheating temperature before rolling, so the crystal grains became coarser and the toughness of the steel material dropped. Further, the steel material of Comparative Example No. 77 had only a low rolling finishing temperature, the apparent hardenability dropped, a sufficient dislocation density could not be obtained, and precipitation of the carbides on the dislocations failed to sufficiently occur, so the 700° C. high temperature yield strength (YS (700)) could not be stably achieved. Further, the steel material of Comparative Example No. 78 dropped in water density and dropped in cooling rate at the time of cooling after the end of rolling and dropped in apparent hardenability, so the 700° C. high temperature yield strength (YS (700)) could not be stably achieved. Further, the steel material of Comparative Example No. 79 had too high a water cooling stop temperature, so while the chemical ingredients are in the range of the present invention, the 700° C. high temperature yield strength (YS (700)) could not be stably achieved. Further, the steel material of Comparative Example No. 80 had too low a water cooling stop temperature, so high temperature yield strength could be achieved at up to 800° C., but the strength became too high and the toughness of the steel material dropped.

Industrial Applicability

According to the present invention, it is possible to obtain steel of a ferrite structure having a stable BCC structure not reaching the $Ac_1$ transformation point even at an envisioned fire temperature, so it is possible to obtain a fire-resistant steel material superior in HAZ toughness of a welded joint able make the yield strength at a high temperature of 700 to 800° C. at least ½ of the yield strength at room temperature and furthermore free from embrittlement of HAZ of the welded joint even after the steel material is exposed to a fire environment.

The invention claimed is:

1. A fire-resistant rolled or worked steel material having HAZ toughness of a welded joint, the fire-resistant rolled or worked steel material comprising, by mass %, C: 0.005% to less than 0.03%,
Si: 0.01 to 0.50%,
Mn: 0.05 to 0.40%,
Cr: 1.50 to 5.00%,
V: 0.05 to 0.50%, and
N: 0.001 to 0.005%,
limiting
Ni: less than 0.10%,
Cu: less than 0.10%,
Mo: less than 0.05%,
B: 0.0003% or less,
having a balance of Fe and unavoidable impurities, and among said unavoidable impurities, limiting
P: less than 0.020%,
S: less than 0.0050%, and
O: less than 0.010%; wherein the fire-resistant steel material is rolled or worked, and has a bainite structure.

2. The fire-resistant rolled or worked steel material having HAZ toughness of a welded joint as set forth in claim 1, further comprising, by mass %, at least one element selected from the group consisting of Ti: over 0.005% to 0.050% and Zr: 0.002 to 0.010%.

3. The fire-resistant rolled or worked steel material having HAZ toughness of a welded joint as set forth in claim 1, further comprising, by mass %, Nb: 0.010 to 0.300% and satisfying the following formula (A) when the Nb content (%) is [Nb] and the C content (%) is [C]:

$$[Nb]\times[C]<0.007 \quad (A).$$

4. The fire-resistant rolled or worked steel material having HAZ toughness of a welded joint as set forth in claim 1, further comprising, by mass %, one or more elements selected from the group consisting of Mg: 0.0005 to 0.005%, Ca: 0.0005 to 0.005%, Y: 0.001% to 0.050%, La: 0.001% to 0.050%, and Ce: 0.001% to 0.050%.

5. The fire-resistant rolled or worked steel material having HAZ toughness of a welded joint as set forth in claim 2, further comprising, by mass %, Nb: 0.010 to 0.300% and satisfying the following formula (A) when the Nb content (%) is [Nb] and the C content (%) is [C]:

$$[Nb]\times[C]<0.007 \quad (A).$$

6. The fire-resistant rolled or worked steel material having HAZ toughness of a welded joint as set forth in claim 2, further comprising, by mass %, one or more elements selected from the group consisting of Mg: 0.0005to 0.005%, Ca: 0.0005 to 0.005%, Y: 0.001% to 0.050%, La: 0.001% to 0.050%, and Ce: 0.001% to 0.050%.

7. The fire-resistant rolled or worked steel material having HAZ toughness of a welded joint as set forth in claim 3, further comprising, by mass %, one or more elements selected from the group consisting of Mg: 0.0005 to 0.005%, Ca: 0.0005 to 0.005%, Y: 0.001% to 0.050%, La: 0.001% to 0.050%, and Ce: 0.001% to 0.050%.

* * * * *